US006494170B2

(12) United States Patent
Moloney et al.

(10) Patent No.: US 6,494,170 B2
(45) Date of Patent: Dec. 17, 2002

(54) TWO-PIECE PISTON ASSEMBLY WITH SKIRT HAVING PIN BORE OIL DUCTS

(75) Inventors: Kevin M. Moloney, Peoria; Christopher J. Watson, East Peoria, both of IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/727,621

(22) Filed: Dec. 1, 2000

(65) Prior Publication Data

US 2002/0066423 A1 Jun. 6, 2002

(51) Int. Cl.[7] ..... F01P 1/04
(52) U.S. Cl. ..... 123/41.35; 123/41.36
(58) Field of Search ..... 123/41.36, 41.35, 123/41.39

(56) References Cited

U.S. PATENT DOCUMENTS

| | | | | | |
|---|---|---|---|---|---|
| 34,139 | A | * | 12/1862 | Copper et al. | 123/193 P |
| 2,372,050 | A | | 3/1945 | Barraja-Frauenfelder | |
| 2,687,931 | A | | 8/1954 | Flynn, Jr. | |
| 2,865,348 | A | | 12/1958 | Kramer et al. | |
| 3,070,079 | A | * | 12/1962 | Seifert | 123/41.36 |
| 4,056,044 | A | * | 11/1977 | Kamman et al. | 123/41.35 |
| 4,206,726 | A | | 6/1980 | Johnson, Jr. et al. | |
| 4,253,429 | A | * | 3/1981 | Galli | 123/41.35 |
| 4,270,494 | A | | 6/1981 | Garter et al. | |
| 4,286,505 | A | | 9/1981 | Amdall | |
| 4,331,107 | A | | 5/1982 | Bruni | |
| 4,506,632 | A | * | 3/1985 | Kanda et al. | 123/41.35 |
| 4,508,065 | A | * | 4/1985 | Suchdev | 123/41.36 |
| 4,517,930 | A | * | 5/1985 | Nakano et al. | 123/41.35 |
| 4,530,312 | A | | 7/1985 | Kanda et al. | |
| 4,847,964 | A | | 7/1989 | Adams et al. | |
| 4,867,119 | A | * | 9/1989 | Cooper et al. | 123/193 P |
| 4,941,440 | A | | 7/1990 | Weber et al. | |
| 4,945,864 | A | * | 8/1990 | Solomon et al. | 123/41.39 |
| 4,986,167 | A | * | 1/1991 | Stratton et al. | 123/41.35 |
| 5,052,280 | A | * | 10/1991 | Kopf et al. | 123/41.35 |
| RE34,139 | E | | 12/1992 | Cooper et al. | |
| 5,279,268 | A | | 1/1994 | Brink et al. | |
| 5,289,758 | A | | 3/1994 | Berlinger | |
| 5,307,732 | A | * | 5/1994 | Berlinger | 123/193.6 |
| 5,730,090 | A | | 3/1998 | Kling et al. | |
| 5,845,611 | A | * | 12/1998 | Schmidt et al. | 123/41.35 |
| 5,890,416 | A | | 4/1999 | Thieme et al. | |
| 6,003,479 | A | | 12/1999 | Evans | |

FOREIGN PATENT DOCUMENTS

| | | |
|---|---|---|
| AU | 197137 | 4/1958 |
| DE | 339430 | 8/1959 |
| DE | 3600-749 A | 7/1987 |
| DE | 3600-750 A | 7/1987 |
| EP | 520536 A1 | 12/1992 |
| EP | 523625 A1 | 1/1993 |
| FR | 917.647 | 1/1947 |
| FR | 1.283.109 | 12/1962 |
| GB | 10314 | 10/1912 |
| IT | 489103 | 1/1954 |
| SU | 1451-311 A | 1/1989 |

* cited by examiner

*Primary Examiner*—Noah P. Kamen
*Assistant Examiner*—Jason Benton
(74) *Attorney, Agent, or Firm*—Gordon Telfer

(57) ABSTRACT

A duct from near the top of the skirt of a two-piece piston carries lubricant to the skirt pin bore, on each side of the skirt, and lubricates the pin joint. The skirt is provided with a lubricant passage, such as from a shaker tray, to the pin bore on each side of the pin joint of the skirt, piston crown struts, and wrist pin on which a piston connecting rod is joined. Fluid sprayed against the crown descends onto the skirt and some passes through the above-mentioned lubricant ducts or passages for direct, continuous lubrication of the pin joint.

15 Claims, 2 Drawing Sheets

TWO-PIECE PISTON ASSEMBLY WITH SKIRT HAVING PIN BORE OIL DUCTS

TECHNICAL FIELD

This invention relates generally to engine pistons and, more particularly, to two-piece pistons with oil cooling of the crown portion.

BACKGROUND ART

Pistons for middle and large sized diesel engines, such as those having a displacement of 5 liters or more, have had considerable attention to achieve increased performance. Two-piece designs for piston assemblies have been widely adopted for such engines.

Two-piece pistons, sometimes referred to as articulated pistons, have a crown that has an upper end surface that forms part of an engine's combustion chamber, and an outer lateral surface carrying the piston rings that run within a cylinder of the engine. The crown is typically of a high strength material, such as machined forged steel, to withstand the pressure and temperature encountered in operation.

Two-piece pistons also include a skirt below the crown that is a separate member typically of a lower strength material then the crown, but one that is lighter and more heat conductive, such as aluminum. The skirt is typically cylindrical and open, or hollow in the center, so an oil coolant can be sprayed up through the skirt against the crown. The skirt helps contain the oil to assist in heat dissipation from the piston. (The sprayed oil is also what provides lubrication for motion between the piston rings and the cylinder wall.)

For example, in U.S. Pat. No. 4,056,044 issued to Kammon, Nov. 1, 1977, a two-piece piston design is disclosed that includes a main body, or crown, and a skirt that are connected through pin bores by a wrist pin to which a connecting rod is attached. A cooling oil is directed against the interior of the crown. An annular groove in the end of the skirt that faces the crown receives at least some of the cooling oil that has drained from the crown and, due to the piston's motion, splashes it out for further cooling and lubricating action. Such an annular groove in a skirt of a two-piece piston is sometimes referred to in the art as a "shaker tray".

Other examples of two-piece pistons include those in U.S. Pat. No. Re. 34,139 issued to Cooper et al., Dec. 8, 1992, which includes further aspects of the form of the crown surface that receives the sprayed oil, and U.S. Pat. No. 4,986,167 issued to Stratton et al., Jan. 22, 1991, that includes a baffle plate to help trap coolant in an annular cooling recess, or cooling gallery, of the crown.

In the prior known two-piece pistons, the pin joint with the wrist pin connecting the crown portion and the skirt, and also joined to the connecting rod, is lubricated merely by random splashing of the jet sprayed oil or else, in engines large enough in size (such as 50 L. or more displacement), a continuous supply of oil to the pin joint through the connecting rod; for example, see above-mentioned U.S. Pat. No. 4,056,044. Random splashing provides lubrication that is uncertain and may be discontinuous. Supplying oil continuously through a passage in the connecting rod is not a very cost effective design for mid-sized engines in a range of, for example, about 5 to about 30 L. displacement.

Lack of cost effective lubrication results in limitations on engine performance and life due to component wear. There is a continuing interest in increasing the specific power (power per unit of displacement) of engines. That tends to make cylinder pressures higher and increase the loading on the piston pin joint which would have the adverse effect of reducing component life.

The present invention is directed to overcoming one or more of the problems or disadvantages associated with the prior art.

DISCLOSURE OF THE INVENTION

The present invention is directed to two-piece piston assemblies with a reliable and cost effective way to provide continuous lubrication to the pin joint of pistons for a wide variety of engine sizes.

The piston assembly includes ducts or passages in the skirt near the top of the skirt, such as from the shaker trays, to the pin bores on each side of the skirt. Some oil, or other fluid coolant and lubricant, that is used to cool the piston crown falls within the ducts and is carried through the ducts to the pin joint of the union of the skirt, crown, and wrist pin for the connecting rod. The invention also increases the effective useful life of engines by reducing wear of critical components such as the piston crown and skirt, the wrist pin, and the connecting rod.

The invention retains the benefits of prior two-piece pistons and their fluid cooling techniques and provides a way to raise the specific power of engines, including diesel engines, for example, in the size range of about 5 to about 30 L. displacement, without requiring a system with oil supplied through a passage in the connecting rod.

BEST MODE FOR CARRYING OUT THE INVENTION

Figure 1:
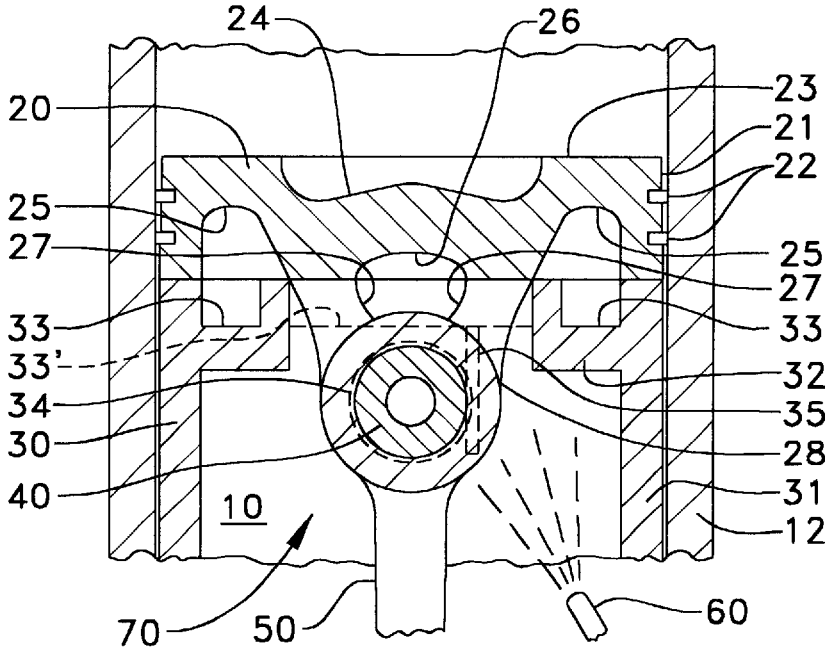
FIG. 1 is a vertical, central sectional view, partly broken away, of a two-piece piston assembly in accordance with an embodiment of the invention, in an engine cylinder.

FIG. 1 shows a two-piece piston assembly 10 in a cylinder 12 of an engine, typically a diesel engine with a number of cylinders each equipped with such a piston. Piston assembly 10 includes a main piston body, or crown, 20 and a skirt 30 each of which will be described further particularly with respect to how lubrication is provided to a pin joint at which each of parts 20 and 30 are located on a wrist pin 40 that also has a connecting rod 50 attached for motion transferred to or compelled by the engine's crankshaft (not shown). Within a lower part of cylinder 12 there is a nozzle 60 that sprays a fluid coolant and lubricant throughout the piston assembly 10.

The general arrangement of crown 20, skirt 30, wrist pin 40, connecting rod 50 and nozzle 60 is generally consistent with known two-piece piston designs which may be modified in certain respects to practice the invention. The expression "two-piece piston assembly" as used herein generally refers to a piston including a two-piece piston and its related wrist pin, connecting rod and coolant nozzle, unless the context indicates otherwise.

The example crown 20 is generally one machined from a steel forging to form a cylindrical outer surface 21 on which piston rings 22 are located that run against the inner surface of the cylinder 12. The crown's upper surface 23 faces and forms part of the combustion chamber of the cylinder 12 and includes a depression 24. The underside of the crown 20 has an annular recess, or cooling gallery, 25 that may extend around substantially all of the crown underside. The cooling gallery 25, and also a central depression 26, help maximize heat transfer. They receive sprayed oil from nozzle 60 that removes heat from the crown 20 produced both by the combustion against surface 23, including depression 24, and the sliding of the piston rings 22 against the cylinder 12.

The crown 20 also includes struts or bosses 27 extending down from the main part with the features described above. In the view of FIG. 1 a strut 27 at the far side of the piston 10 is shown. An additional strut 27 is symmetrically arranged on the near side of the piston 10 which is not illustrated in this sectional view. The crown struts 27 extend within the generally cylindrical skirt 30 and have a pin bore 28 through which the wrist pin 40 extends.

The crown 20 may have any of a variety of particular configurations and may be like crowns of prior two-piece pistons.

The skirt 30 of the piston 10 is, however, significantly modified from past practice. In FIG. 1 the skirt 30 has a generally vertical cylindrical wall 31 the outer surface of which is spaced from the cylinder 12, substantially like the crown surface 21 (other than rings 22). As in the prior designs referred to above, the upper part of the skirt 30 has features that have significant relation to the underside of the crown 20. A part of the upper periphery or edge 32 includes one or more annular grooves or shaker trays 33. (More accurately scaled illustration of example shaker trays 33 is in FIG. 3.) Shaker trays 33 perform the function they have in prior designs of receiving at least some of the oil that descends from the crown 20, particularly cooling gallery 25, and helping heat transfer by the repetitive splashing and shaking the coolant gets in the shaker trays 33 during the motion of the piston 10. The configuration of the trays 33 helps to retain the oil, temporarily, before it eventually drains out the piston, so that heat transfer to the oil is maximized.

The skirt 30 has pin bores 34 (not shown clearly in FIG. 1 but like those shown in FIGS. 2 and 3 at 134 and 234, respectively) located outside and in alignment with the pin bores 28 of the crown struts 27. Wrist pin 40, attached to the connecting rod 50, extends through the pin bores of the crown 20 and the skirt 30. The wrist pin joint with the respective pin bores of the crown and skirt is referred to generally by reference numeral 70. The wrist pin joint 70 is journalled, or positioned, for relative motion within the pin bores of the crown struts 27 and the skirt 30, substantially as in a journal bearing.

Figure 2:
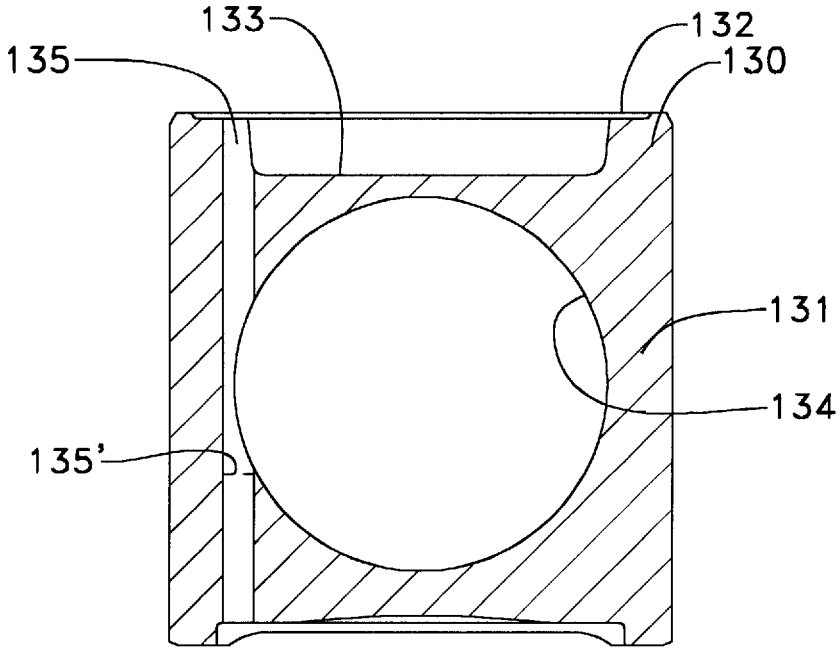
FIG. 2 is a vertical sectional view of a skirt of a two-piece piston assembly in accordance with an embodiment of the invention, such sectional view being taken on a vertical plane through the longitudinal wall of the skirt intersecting a pin bore.

In FIG. 1, a shaker tray 33' over a pin bore on the far side of the skirt communicates directly by a duct 35 through the skirt wall to the pin joint 70. Some of the fluid in the shaker tray 33' passes through the duct 35 for continuous positive lubrication, and cooling, of the pin joint 70. (A like configuration of a shaker tray and lube duct is provided on the near side of the skirt 30 as well; see FIG. 3 for example. FIG. 2 illustrates further details in a sectional view through a pin bore.)

The ability to continuously lubricate the pin joint 70 through duct 35 permits higher specific power and lower wear for a longer life from the piston assembly and, by the present invention, that can be accomplished without the expense incurred by having oil fed through a special passage in the connecting rod.

As shown in the example of FIG. 1, duct 35 extends to the pin joint 70, including the pin bore of skirt 30, pin bore, but not beyond. As in the past, the fluid (oil) sprayed from nozzle 60 eventually descends down to the engine's crankcase (not shown). In the FIG. 1 embodiment, oil through duct 35 to the pin joint 70 will lubricate the journalled parts at the crown and skirt pin bores. Sprayed oil from nozzle 60, not relied on as the sole means for lubricating the pin joint 70, still occurs and adds to lubricating all the journalled parts.

Figure 3:
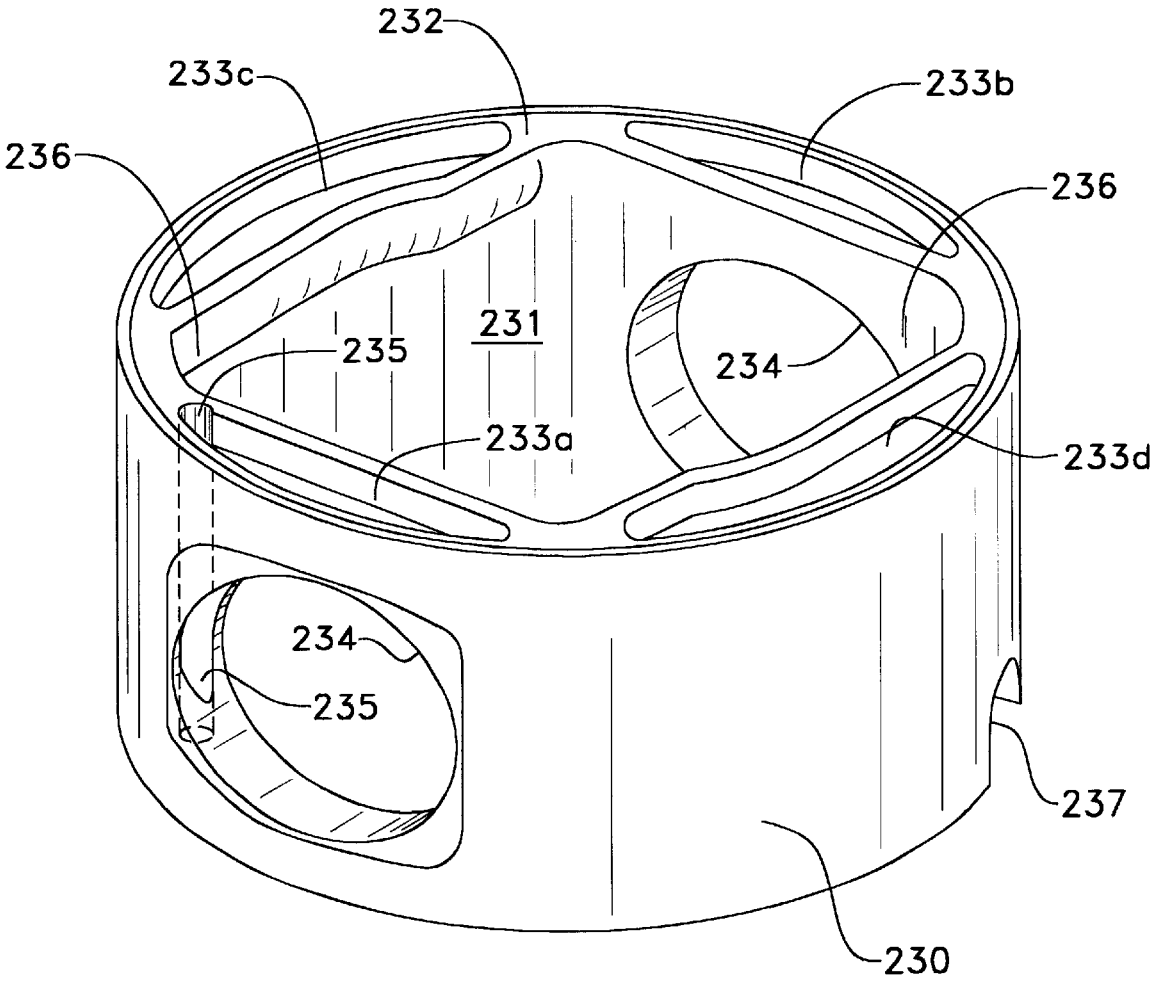
FIG. 3 is a perspective view of a skirt of a two-piece piston assembly in accordance with an embodiment of the present invention.

Elements of FIGS. 2 and 3 generally have reference numbers with two last digits like the reference numbers of the corresponding elements of FIG. 1.

FIG. 2 shows a view of a skirt 130 that includes features that are part of the inventive combination. This sectional view is taken through a skirt wall including a skirt pin bore 134. Among the features shown are a shaker tray 133, in one corner in this example, and a duct 135 between the shaker tray 133, in one corner in this example, to the pin bore 134. In contrast to FIG. 1, FIG. 2 shows an alternative in which duct 135 extends not only to the pin bore 134, but past the pin bore to the lower edge of the skirt. Dashed line 135' indicates the approximate location of the termination of the duct 35 as shown in FIG. 1. While either arrangement is useful, it is presently believed a closed-end arrangement as in FIG. 1 is generally preferred to maximize the lubrication at the pin joint.

FIG. 3 shows a skirt 230 for use in the invention. In this example, the skirt 230 has four shaker trays 233*a*, 233*b*, 233*c*, and 233*d*. Two of the shaker trays 233*a* and 233*b* are over respective skirt pin bores 234. The near left shaker tray 233*a* is shown with a duct 235 extending from the shaker tray 233*a* to the pin bore 234. The opposite shaker tray 233*b* has a like duct to its proximate pin bore 234, at the right edge of the shaker tray and pin bore, not visible in this view.

The skirt 230 of FIG. 3 includes cutbacks or cutouts (notch regions) 236 in the walls of the shaker trays 233*c* and 233*d* and between the trays 233*c* and 233*a* and between trays 233*d* and 233*b*. The regions 236 of the skirt 230 are related to the configuration of the crown of the piston and provide sufficient clearance during engine operation for an oil spray nozzle (e.g., 60 and FIG. 1) to reach a crown cooling gallery (25 in FIG. 1). (Regions similar to regions 236 of FIG. 3 are not shown in FIG. 1 for simplicity of illustration but would be present to enable the oil to cool the crown.)

FIG. 3 also shows an oil jet notch 237 in the lower right edge of the skirt 230 for location of an oil jet similar to nozzle 60 of FIG. 1

The illustrated embodiments of FIGS. 1, 2, and 3 all include ducts 35, 135 and 235 that extend from shaker trays in the top of the skirt. That helps ensures continuity of the supply of oil to the pin bore. More generally, the upper opening of the ducts carrying lubricant to the pin bores may be at a location in the upper part of the skirt, not necessarily within shaker trays, where coolant sprayed from nozzle 60 will be received. Further, the examples shown have just one duct 35, 135, 235 for oil to each pin bore. However, additional pin bore oil ducts may be included if desired.

INDUSTRIAL APPLICABILITY

The invention provides a way to improve the pin joint lubrication of two-piece engine pistons that is reliable and also relatively easy and economical to implement compared to prior techniques.

While the invention may be used in a wide variety of engines, it is particularly well suited for mid-sized diesel engines such as from about 6 L. to 30 L. displacement that have previously not had direct pin joint lubrication. Engines equipped with pistons according to the invention, having a lubricant duct from skirt shaker trays to pin bores, can be operated with increased specific power compared with a similar engine without direct pin joint lubrication. Also, pin joint wear is reduced to provide a longer life for an engine.

Other aspects and features of the present invention can be obtained from a study of the drawings, the disclosure, and the appended claims.

What is claimed is:

1. A fluid cooled, two-piece, piston assembly for use in an engine and comprising:

a piston crown and a skirt each having a pair of oppositely disposed pin bores accommodating a wrist pin pivotally located therein;

a nozzle directed to spray a coolant fluid upward throughout the interior of the skirt to the crown; and a number of fluid passages within the skirt each extending from near the top of the skirt adjacent the crown to one of the skirt pin bores for direct lubrication of the wrist pin.

2. The piston assembly of claim 1 including:

a connecting rod attached to the wrist pin.

3. The piston assembly of claim 2 wherein:

the fluid passages in the skirt extend to the skirt pin bores from respective shaker trays at the top of the skirt adjacent the crown that receive fluid descending from the crown.

4. The piston assembly of claim 3 including:

a cooling recess in the surface of the crown adjacent the shaker trays having the fluid passages extending therefrom.

5. A fluid cooled, two-piece piston assembly for use in an engine and comprising:

a crown having an upper surface and a downwardly facing cooling recess and also having oppositely disposed struts that downwardly extend and each include a pin bore;

a skirt located with the pin bore struts of the crown extending therein and having a pair of oppositely located skirt pin bores that are aligned with the strut pin bores;

the skirt also having an upper end surface facing parts of the cooling recess of the crown and with cutout regions between adjacent shaker trays that allow a fluid coolant to be sprayed upwardly against the crown cooling recess; and the skirt also having a duct from each of at least two upper locations proximate the cooling recess of the crown that extends to a respective pin bore to carry some of the fluid coolant to lubricate the pin bores.

6. The piston assembly of claim 5 wherein:

the downwardly facing cooling recess of the crown has an annular configuration;

two shaker trays of the skirt are located above the pin bores and two others respectively between the two that are above the pin bores; and the ducts to the pin bores extend from within each of the two shaker trays located above the pin bores.

7. The piston assembly of claim 5 including:

a wrist pin extending through the pin bores of the struts and the skirt, the wrist pin being journalled for reciprocating motion with lubrication from the fluid passing through the ducts in the skirt.

8. The piston assembly of claim 5 wherein:

the crown consists essentially of steel and the skirt consists essentially of aluminum.

9. The piston assembly of claim 7 wherein:

the lubricant carried by ducts in the skirt passes out through the pin bores around the journalled wrist pin.

10. A two-piece engine piston assembly with a fluid cooling and lubricating arrangement comprising:

a crown, a skirt, and a spray jet for directing a fluid coolant against the underside of the crown;

the crown having downwardly extending struts with opposing pin bores, the skirt encircling the struts of the crown and having opposing pin bores aligned with those of the struts;

a wrist pin, for a connecting rod, journalled within the pin bores of the skirt and struts;

the skirt having a generally cylindrical shape with an upper edge facing a peripheral part of a lower surface of the crown, the skirt upper edge including a plurality of shaker trays that receive fluid from the crown surface and splash back fluid to further cool the crown during reciprocating motion of the assembly, and the skirt further has a pair of the shaker trays that each communicate with a respective duct to supply fluid to one of the skirt pin bores as lubricant to the wrist pin.

11. The piston assembly of claim 10 where:

the crown and the skirt are separate elements that are unjoined apart from the wrist pin journalled in the respective pin bores.

12. The piston assembly of claim 11 where:

the spray jet introduces to the assembly the sole fluid for cooling and lubricating.

13. The piston assembly of claim 12 where:

the sprayed fluid of the spray jet impinges on the wrist pin within the pin bores and contributes to their lubrication in addition to lubrication by fluid supplied from the shaker trays.

14. The piston assembly of claim 13 where:

the crown and the skirt are of different composition to provide the crown with greater strength and the skirt with lighter weight and more heat conductivity.

15. The piston assembly of claim 14 where:

the crown is of steel and the skirt is of aluminum.

* * * * *